United States Patent [19]

Levin et al.

[11] 4,150,316

[45] Apr. 17, 1979

[54] INCANDESCENT PROJECTION LAMP WITH INTERNAL REFLECTOR HAVING LIGHT DEFINING OPENING THEREIN

[75] Inventors: Robert E. Levin; Robert P. Bonazoli, both of South Hamilton, Mass.

[73] Assignee: GTE Sylvania Incorporated, Danvers, Mass.

[21] Appl. No.: 758,990

[22] Filed: Jan. 13, 1977

[51] Int. Cl.[2] ..... H01J 5/16

[52] U.S. Cl. ..... 313/113; 362/296; 362/347

[58] Field of Search ..... 313/113, 114, 115; 240/41.25, 41.3, 41.35

[56] References Cited

U.S. PATENT DOCUMENTS

| | | | |
|---|---|---|---|
| 1,637,429 | 8/1927 | Stewart | 240/41.35 |
| 2,261,001 | 10/1941 | Muldoon | 240/41.35 |
| 2,810,321 | 10/1957 | Ulffers | 240/41.3 |
| 3,025,424 | 3/1962 | Wiley et al. | 313/115 |
| 3,555,338 | 1/1971 | Scoledge | 313/113 |
| 3,622,832 | 11/1971 | Schlessel | 313/113 |

*Primary Examiner*—John Kominski

*Attorney, Agent, or Firm*—Lawrence R. Fraley

[57] ABSTRACT

An incandescent projection lamp which includes a reflector located within the lamp's envelope at an established distance from a biplanar filament structure. The lamp provides bidirectional light output with the reflector having an opening therein for defining the light output in one of the directions.

9 Claims, 5 Drawing Figures

INCANDESCENT PROJECTION LAMP WITH INTERNAL REFLECTOR HAVING LIGHT DEFINING OPENING THEREIN

CROSS REFERENCE TO CO-PENDING APPLICATION

An application entitled "Overhead Projection System With Lens Assembly Having Concentrically-Oriented Condensing Lenses" is filed concurrently under Ser. No. 758,988. Ser. No. 758,988 is assigned to the same assignee as the present invention and defines therein a projection system which may utilize the present invention.

BACKGROUND OF THE INVENTION

This invention relates to incandescent projection lamps and more particularly to such lamps which include a reflector within the lamp's envelope.

It is well known in the projection lamp art to utilize an internal (or proximity) reflector within the lamp's envelope. A hermetically sealed internal reflector is protected against oxidation, dirt, and other adverse conditions typically found in the lamp's environment. Internal reflectors also assure a cooler operating lamp due to the ability of such components to reflect much of the heat from the envelope's rear walls. Perhaps the most significant gain however is in the projection system's screen brightness as a result of the reflector's ability to direct the lamp's output in the substantially singular primary direction.

As will be described, the present invention defines an internal reflector projection lamp which is capable of providing a bidirectional light output. That is, the lamp's output is substantially concentrated in two opposing directions. One particular use for the lamp of the invention is within the projection system described in the aforementioned copending application under Ser. No. 758,988. The overhead projection system in Ser. No. 758,988 utilizes a lens assembly which includes therein a pair of condensing lenses each having a different focal length. It is desired in the system to use a singular light source and to expose the lens assembly to both direct and indirect (reflected) light.

OBJECTS AND SUMMARY OF THE INVENTION

It is an object of the invention to provide an improved incandescent projection lamp having an internal reflector within the lamp's envelope.

It is a further object of this invention to provide an internal reflector projection lamp which is capable of providing light output in two primary directions with a predetermined ratio of light between the two directions.

According to one aspect of the invention, there is provided an incandescent projection lamp which comprises a base, a light-transmitting glass envelope secured to the base, a filament structure within the envelope, and a reflector member positioned within the envelope at a distance from the filament structure. The reflector reflects the filament's light in a first direction and includes at least one opening therein for passing light therethrough in a second direction substantially opposing the first.

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawings.

Figure 1:
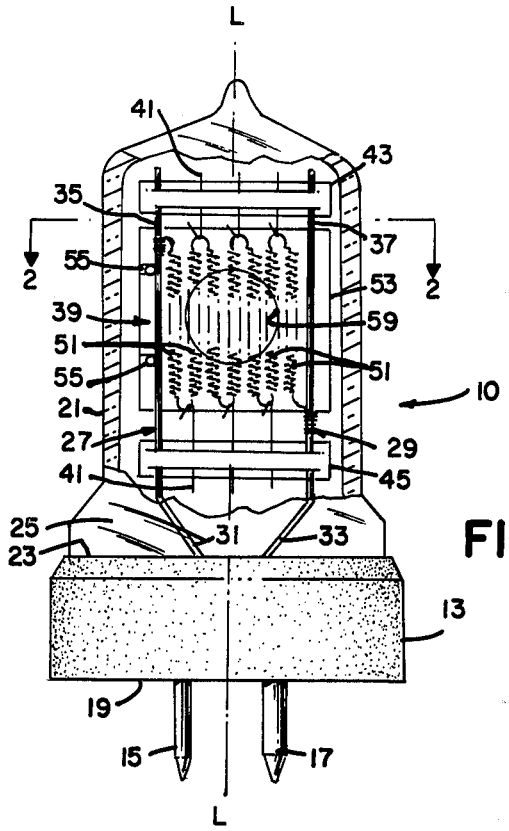
FIG. 1 is a front elevational view, partly in section, of a projection lamp in accordance with a preferred embodiment of the invention.
Figure 2:
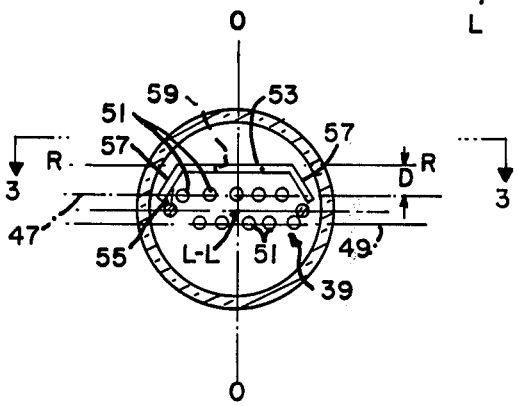
FIG. 2 is a top plan view, partly in section as taken along the line 2—2 in FIG. 1.

With particular reference to FIG. 1, there is shown an incandescent projection lamp 10 in accordance with a preferred embodiment of the invention. Lamp 10 comprises a base 13, at least two electrically conductive pins 15 and 17 projecting from a first side 19 of base 13, and a light-transmitting envelope 21 secured to base 13 and projecting from a second side 23 thereof. Envelope 21 preferably includes a pinch-seal portion 25 which is rigidly held within base 13 using a basing cement (not shown). It is also preferred that envelope 21 be of quartz or a high silica glass such as Vycor. Additionally, envelope 21 may be either oval or round (as shown in FIG. 2) in cross-section. Located within envelope 21 is a pair of spaced-apart electrically conductive support rods 27 and 29 which each have a first end portion (31 and 33, respectively) positioned within base 13 and electrically joined to pins 15 and 17, respectively. Rods 27 and 29 also include a second end portion (35 and 37, respectively) which extend within envelope 21.

Figure 3:
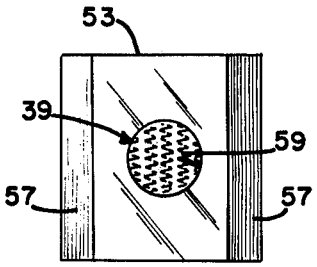
FIG. 3 is a rear elevational view as taken along the line 3—3 in FIG. 2.

Electrically joined to ends 35 and 37 is a filament structure 39 (shown partly in phantom) which is pendantly mounted on a plurality of hooked retaining wires 41. Wires 41 are spacedly mounted within a pair of spaced-apart quartz rods 43 and 45 which are mounted orthogonal to the longitudinal axis "L—L" of envelope 21. As shown in FIG. 1, support rods 27 and 29 are also retained within opposing ends of the insulative rods 43 and 45. Filament structure 39 is preferably biplanar as illustrated in FIG. 2 where the structure is shown as comprised of two separate planar rows 47 and 49 of coiled filamentary elements 51. This biplanar arrangement is ideal for projection applications because the offset elements 51 in rows 47 and 49 present a solid appearance when viewed from the front or back of the lamp, i.e. FIGS. 1 and 3, respectively.

Lamp 10 also comprises a reflector member 53 positioned within envelope 21 at a preestablished distance ("D" in FIG. 2) from filament structure 39. Reflector 53, which may be molybdenum, tungsten, or tantalum, is preferably of rectangular configuration, occupying a plane "R—R" (FIG. 2) substantially parallel to longitudinal axis "L—L". It is understood that in FIG. 2 the envelope's longitudinal axis is perpendicular to the drawing and passes through the central point indicated by the letters "L—L". Also passing through this point is the lamp's optical axis "O—O". Axis "O—O" also perpendicularly passes through the center of reflector 53. Reflector 53 is affixed to support rod 27 using a pair of connecting tabs 55. As further shown in FIG. 2, the biplanar filament structure 39 is parallel to the planar reflector 53. To further enhance the reflective capabilities of reflector 53, a pair of panel members 57 are attached to respective opposing sides of the reflector and angularly extend therefrom. Panels 57 may form an integral part of reflector 53 or may be attached thereto as separate components.

Figure 5:
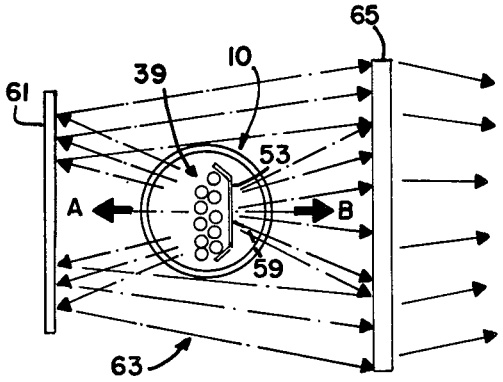
FIG. 5 is a top plan view of a projection system employing the instant invention.

As previously stated, one of the main features of the invention is the ability to project light in substantially two primary directions. This capability is attained by provision of at least one opening 59 within reflector 53. Opening 59, preferably circular and centrally located within the rectangular reflector, permits passage of light therethrough. As shown in FIG. 5, lamp 10 is capable of providing light output in two opposing primary directions ("A" and "B"). Directions "A" and "B" are to the front and rear of lamp 10, respectively. Reflector 53 thus reflects a first amount of light from filament structure 39 in a first direction ("A") toward the front of lamp 10 and permits passage of a second amount of light from structure 39 in a second direction ("B") toward the rear of the lamp. With reference to FIG. 5, the light passing from the front of the lamp is shown as engaging a reflector member 61 within a projection system 63. The reflected or indirect light thereafter impinges on the systems's lens assembly 65. Lens 65 in shown in FIG. 5 as also receiving direct light from the rear of lamp 10, said light passing through opening 59 (hidden). Light passing through lens 65 thereafter passes through a transparency to project an image therefrom on a distant viewing screen.

The preferred ratio of light projected in forward direction "A" to the rearwardly projected light in direction "B" is about 3:1, said ratio desired for the overhead projection system defined in the aforementioned copending application.

Figure 4:
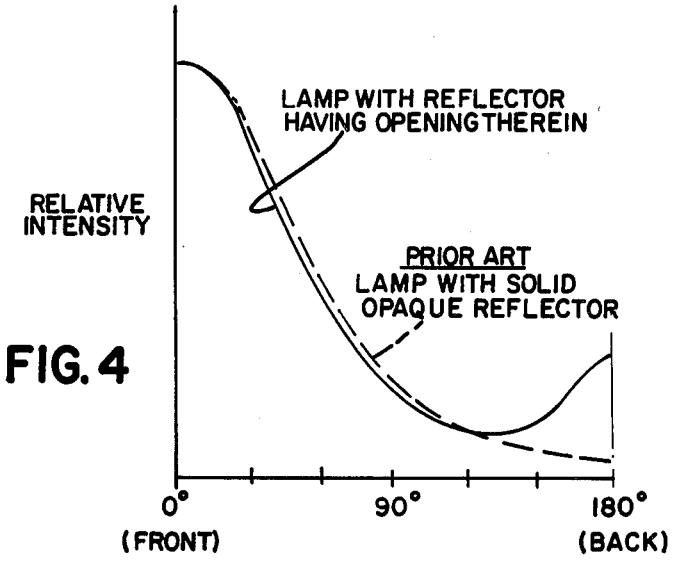
FIG. 4 is a graph depicting the relative intensity values for the lamp of FIG. 1 and prior art internal reflector projection lamp.

The graph in FIG. 4 represents a comparison of relative intensity values as measured from the lamp in FIG. 1 and a prior art incandescent projection lamp having a solid, opaque reflector therein. The horizontal axis on the graph represents the respective positioning relationships for the measured lamps as taken during a 180° rotation. 0° thus represents the full front of the lamps (as shown in FIG. 1 for lamp 10) while the 180° value represents the rear of both lamps. Both lamps provide approximately the same luminous output in the forward direction (at 0°) but the lamp of the invention provides a significantly greater output in the rearward direction (at 180°). As previously stated and now shown in FIG. 4, the rearward luminous output of the lamp of the present invention is about one-third the forward luminous output. Conversely, the rearward output of a typical prior art lamp approaches zero.

Lamp 10 is preferably of the tungsten-halogen variety. That is, each of the filamentary elements 51 is tungsten and envelope 21 includes therein a halogen-containing atmosphere. The atmosphere consists of an inert gas, e.g. argon, and a halogen, e.g. bromine, iodine or chlorine, which serves as a regenerative getter. Tungsten vapors which volatilize from the hot filament structure 39 chemically combine with the halogen to form a compound. This compound migrates to the vicinity of structure 39 whereupon the tungsten is released for redeposit on one of the elements 51. Lamps which operate in this manner are known and have been available on the market. All of lamp 10 as shown in FIG. 1 is therefore considered prior art with the unique exception of providing an internal reflector oriented in the manner defined within lamp 10 and having an opening therein to permit proportioned light output from the lamp in two opposing directions.

Another significant advantage of the instant invention is that the central portion of the lamp's filament structure 39 will operate at a cooler temperature than a comparative lamp without a reflector. In a reflectorless lamp, the central coils operate at a higher temperature than the peripheral elements due to a mutual interchange of radiant power in all directions in the plane of the structure. That is, the outer coils and the ends of all coils are cooler due to outward radiation in the plane of the filament structure without returned power. Additionally, the coil ends lose power by conduction to the respective support rods 27 and 29. Because the reflector 53 of the invention works primarily on the above-described normally cooler outer regions of structure 39 and not on the central region, the end result is a filament structure having a significantly smaller temperature differential. The above feature will prolong the normal operating life of structure 39 and therefore lamp 10. The above feature is also considered of particular importance in tungsten filament lamps because tungsten luminance is a nonlinear function of tungsten temperature whereas the filament life under normal conditions is primarily dependent on the highest temperature attainable by the filament. Therefore, the reflector of the invention will tend to increase the average luminance of the filament structure 39 as viewed from the front. It should further be added that although the preferred embodiment shown in FIG. 1 depicts a separate base and envelope structure, the invention is also applicable to lamps wherein the base forms a part of the envelope. Furthermore, the protruding pins 15 and 17 may simply comprise extensions of the respective support rods 27 and 29.

While there have been shown and described what are at present considered the preferred embodiments of the invention it will be obvious to those skilled in the art that various changes and modifications may be made therein without departing from the scope of the invention as defined by the appended claims.

What is claimed is:

1. In an incandescent projection lamp for use within a projection system having a reflector member and a lens assembly wherein said lamp includes a base, at least two electrically conductive pins projecting from a first side of said base, a light-transmitting elongated envelope secured to said base and projecting from a second side thereof, said envelope including a halogen-containing atmosphere therein, a pair of spaced-apart electrically conductive support rods each having a first end positioned within said base and electrically connected to a respective one of said conductive pins and a second end extending within said envelope, a tungsten filament structure substantially centrally oriented within said envelope and electrically joined to said support rods, and a reflector positioned within said envelope at a preestablished distance from said filament structure, the improvement wherein said reflector comprises:

a planar member positioned substantially parallel to said filament structure and including an opening therein whereby said planar member will reflect a first amount of light from said filament structure in a first direction toward said reflector member of said projection system and said opening will permit a second amount of light from said filament to pass through said planar member in a second direction opposing said first direction and toward said lens assembly of said projection system, said planar member reflecting heat from said filament primarily onto the outer regions of said filament.

2. The projection lamp according to claim 1 wherein the ratio of said first amount of light reflected in said first direction to said second amount of light passing through said reflector in said second direction is about 3:1.

3. The projection lamp according to claim 1 wherein said envelope is quartz.

4. The projection lamp according to claim 1 wherein said reflector member is affixed to one of said support rods.

5. The projection lamp according to claim 1 wherein said reflector member is parallel to the longitudinal axis of said envelope.

6. The projection lamp according to claim 5 wherein said filament structure comprises a biplanar array of filamentary elements, said array substantially parallel to said reflector member.

7. The projection lamp according to claim 5 wherein said reflector is substantially rectangular and said opening is substantially circular.

8. The projection lamp according to claim 5 further including a pair of panel members each extending from a respective side of said planar reflector member at an angle therewith.

9. The projection lamp according to claim 7 wherein said opening is centrally located within said reflector member.

* * * * *